US009656836B2

(12) United States Patent
Unger

(10) Patent No.: US 9,656,836 B2
(45) Date of Patent: May 23, 2017

(54) SAFETY DEVICE COMPRISING TWO STRAPS WITH DIFFERENT FRACTURE STRENGTHS

(71) Applicant: John Peter Unger, Mukwonago, WI (US)

(72) Inventor: John Peter Unger, Mukwonago, WI (US)

( * ) Notice: Subject to any disclaimer, the term of this patent is extended or adjusted under 35 U.S.C. 154(b) by 190 days.

(21) Appl. No.: 14/599,480

(22) Filed: Jan. 17, 2015

(65) Prior Publication Data

US 2015/0266705 A1 Sep. 24, 2015

Related U.S. Application Data

(60) Provisional application No. 61/995,008, filed on Mar. 21, 2014.

(51) Int. Cl.
*B66C 1/18* (2006.01)
*B66C 1/12* (2006.01)

(52) U.S. Cl.
CPC ..... *B66C 1/18* (2013.01); *B66C 1/122* (2013.01)

(58) Field of Classification Search
CPC .. B66C 1/18; B66C 1/12; B66C 1/122; A62B 1/16; A62B 35/00; B64D 17/36
See application file for complete search history.

(56) References Cited

U.S. PATENT DOCUMENTS 2,475,631 A * 7/1949 Miller ..... B64D 17/30 244/151 R
2,985,480 A * 5/1961 Otley ..... B66C 1/18 105/354
3,173,539 A * 3/1965 Looker ..... B65D 19/44 206/597
3,290,083 A * 12/1966 Norton ..... B66C 1/18 294/74
3,368,837 A * 2/1968 Norton ..... B66C 1/18 294/74
RE26,704 E * 11/1969 Norton ..... B66C 1/18 294/74
3,622,025 A * 11/1971 Petersen ..... B63C 3/12 294/74
3,804,698 A * 4/1974 Kinloch ..... B60R 22/28 156/702
3,937,407 A * 2/1976 Matsuo ..... B64D 17/36 188/376
4,200,325 A * 4/1980 Johnson ..... B66C 1/18 294/74
4,446,944 A * 5/1984 Forrest ..... A62B 35/04 182/3
4,856,836 A * 8/1989 Delphin ..... B66C 1/18 294/74
5,174,410 A * 12/1992 Casebolt ..... F16F 7/006 182/3

(Continued)

*Primary Examiner* — Michael Safavi
(74) *Attorney, Agent, or Firm* — James Earl Lowe, Jr.

(57) ABSTRACT

A safety device comprising two straps, the first strap being of a shorter length and a smaller fracture strength, and the second strap being of a longer length and a larger fracture strength, with one end of the first strap and one end of the second strap being adapted to be attached together to a hoisting rope, and the other end of the first strap and the other end of the second strap being adapted to be attached together to a tie back attachment point.

20 Claims, 2 Drawing Sheets

(56) References Cited

U.S. PATENT DOCUMENTS

| | | | | | |
|---|---|---|---|---|---|
| 5,238,279 | A * | 8/1993 | Anteau | B66C 1/18 | 294/74 |
| 5,279,386 | A * | 1/1994 | Cearley | A62B 35/0031 | 119/907 |
| 5,598,900 | A * | 2/1997 | O'Rourke | A62B 35/0056 | 182/18 |
| 5,871,183 | A * | 2/1999 | Milluzzi | B62B 1/045 | 224/274 |
| 6,062,173 | A * | 5/2000 | Heinrichs | A61G 7/1015 | 119/770 |
| 6,331,024 | B1 * | 12/2001 | Gulley | B66C 1/18 | 294/74 |
| 8,302,487 | B2 | 11/2012 | Groeneveld et al. | | |
| 8,356,691 | B2 * | 1/2013 | Griffith | A62B 35/04 | 182/18 |
| 2008/0277952 | A1 * | 11/2008 | Inkel | B66C 1/18 | 294/74 |

* cited by examiner

SAFETY DEVICE COMPRISING TWO STRAPS WITH DIFFERENT FRACTURE STRENGTHS

BACKGROUND

This disclosure relates to a safety device adapted to be placed between a hoisting rope and a tie back attachment point when the hoisting rope is not in use. The hoist rope is typically part of a hoisting machine, such as a crane or an electric mining shovel.

Crane ropes with overhaul balls, lift blocks or end rigging at the end of hoist ropes are usually secured or tied back to the structure of the crane when not in use, or when transporting the crane. The purpose of the tie back is to prevent injury to personnel or damage to crane components resulting from uncontrolled swinging of the crane hook or rigging.

It is a relatively common situation, where a crane operator, due to some temporary inattentiveness, does not remove the tied back line or forgets that such lines are tied back by some type of rigging, and begins to advance or raise the boom or line on a RT crane, or boom down or advance the line on a crawler crane. This causes the secured line or rigging or structure to break once its ultimate fracture strength is exceeded. When this happens, part of the hoist machine rigging can be released and fly through the air with destructive force.

It is therefore advantageous to provide an indication to the crane operator, to forewarn the crane carrier operator, and any bystanders, of a potentially destructive and dangerous situation involving an overload condition.

SUMMARY

Disclosed is a safety device adapted to be placed between a hoisting rope and a tie back attachment point when the hoisting rope is not in use. The safety device comprises two straps, the first strap being of a shorter length and a smaller fracture strength, and the second strap being of a longer length and a larger fracture strength, with one end of the first strap and one end of the second strap being adapted to be attached together to the hoisting rope, and the other end of the first strap and the other end of the second strap being adapted to be attached together to the tie back attachment point.

In one embodiment, the safety device straps are made from weaved synthetic material, the second strap having an inner portion folded back upon itself so that the folded length of the second strap is the same as the first strap. A loop is formed at the end of each and every strap, the second strap being wider than the first strap, and the second strap being thicker than the first strap.

Figure 1:
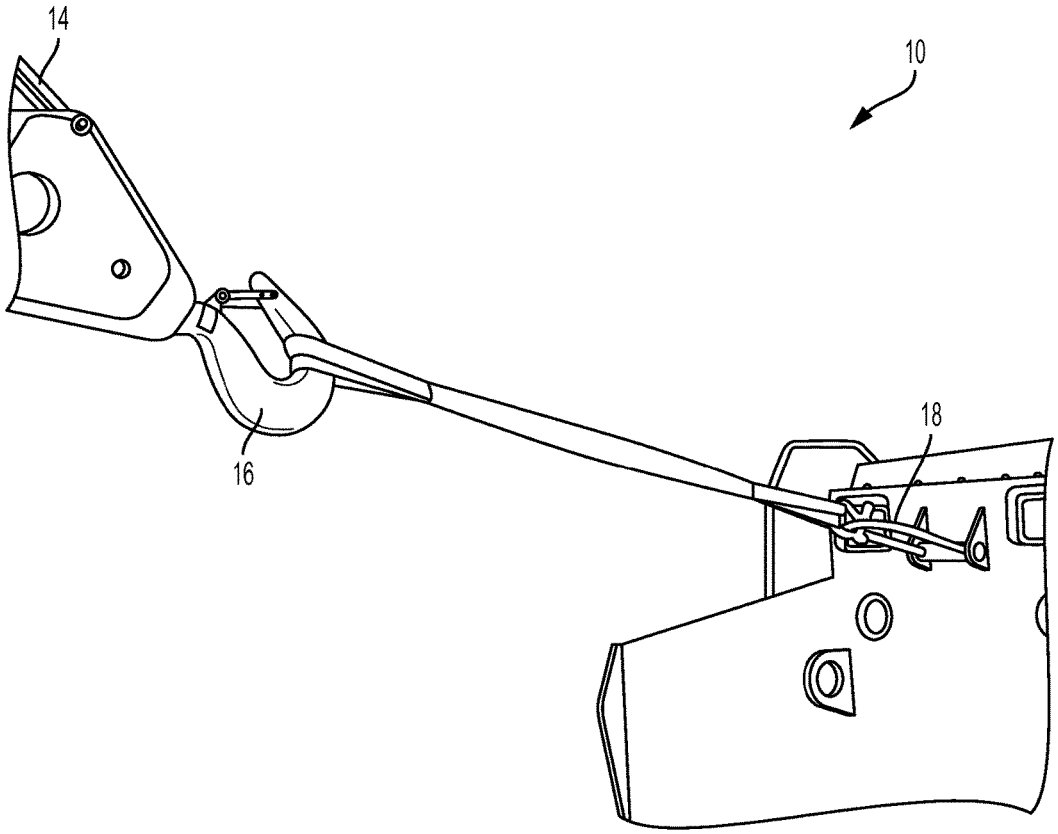
FIG. 1 is a side view of a safety device located between a hoisting rope and an attachment point.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DESCRIPTION OF THE EMBODIMENTS

Disclosed in the drawings is a safety device 10 adapted to be placed between a hoisting rope 14 and a tie back attachment point 18 when the hoisting rope 14 is not in use. The safety device 10 comprises two straps, the first strap 22 being of a shorter length and a smaller fracture strength, and the second strap 26 being of a longer length and a larger fracture strength. One end 34 of the first strap 22 (see FIG. 3) and one end 38 of the second strap 26 are adapted to be attached together to the hoisting rope 14, and the other end of the first strap 22 and the other end of the second strap 26 are adapted to be attached together to the tie back attachment point 18.

Figure 2:
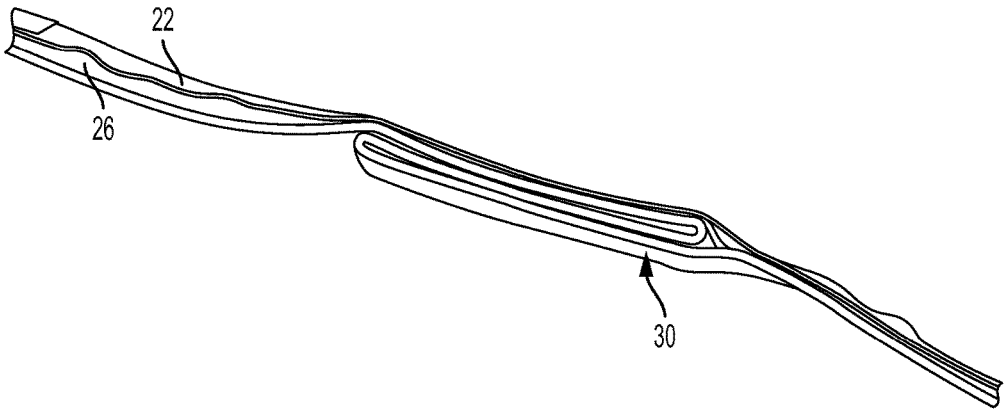
FIG. 2 is a side view of another embodiment of the safety device.
Figure 4:
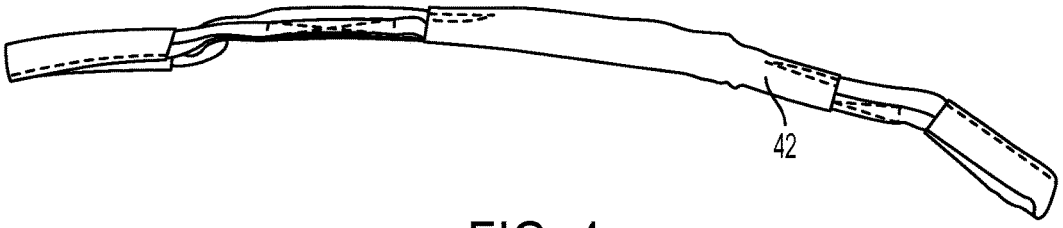
FIG. 4 is a perspective view of another embodiment of the safety device.

In order to make the overall length of both straps the same, the second strap 26 has an inner portion 30 folded back upon itself, as shown in FIG. 2, so that the folded length of the second strap 26 is the same as the first strap 22. In other embodiments (not shown), the second strap may not be folded. The portion 30 folded upon back itself is then stitched together, and the first strap 22 and second strap 26 are stitched together. This stitching is only an accommodation in order to have the strap appear as one solid member, as shown in FIGS. 1 and 4, so the stitching can be omitted in other embodiments.

The one end of the safety device 10 intended to be attached to the hoist rope 14 can be attached to the hoist rope through hoist rope rigging, for example, a crane hook 16 or rigging chains, or any other means typically present at the end of one or more hoist ropes.

Figure 3:
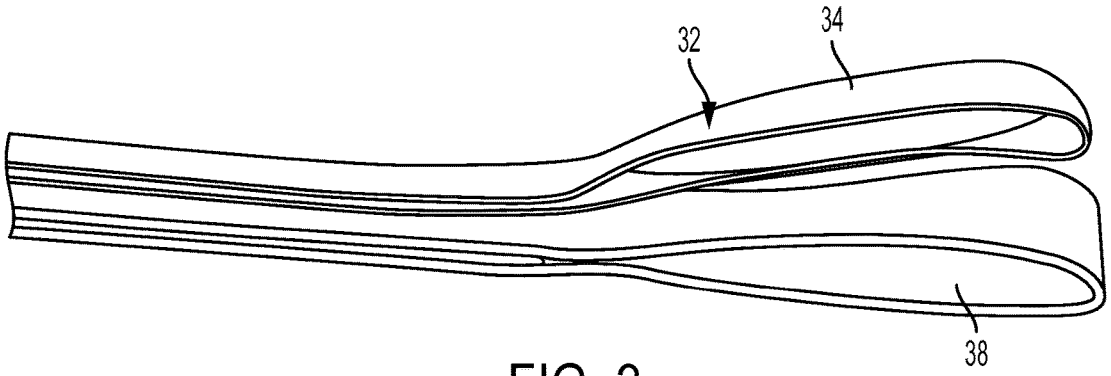
FIG. 3 is a perspective side view of an end of the safety device of FIG. 2.
Figure 5:
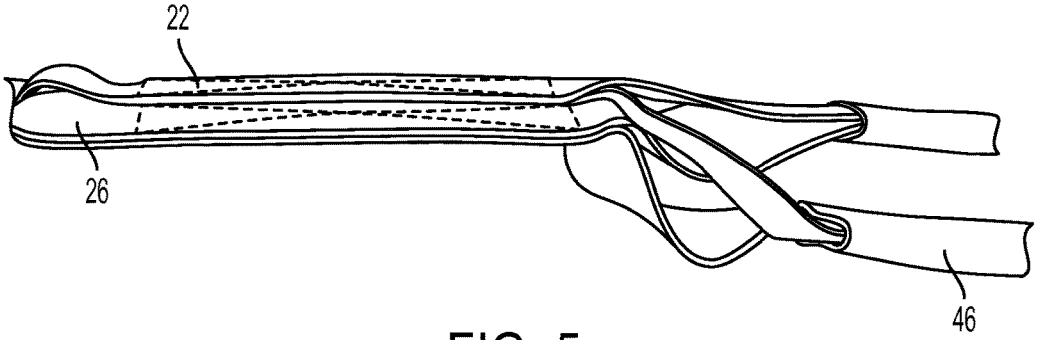
FIG. 5 is a perspective side view of a portion of the end of the safety device of FIG. 4.

As illustrated in the drawings, a loop 32 is formed at the end of each and every strap by having a strap end piece folded back upon a near portion of the strap. More particularly, where the strap end piece is folded back upon the near portion of the strap, it is secured in place by stitching, as illustrated in FIGS. 3 and 5, so that the loop connection fracture strength exceeds the fracture strength of the remainder of the safety device 10. This prevents the loop from breaking before the strap itself fractures. In other embodiments (not shown), other means, such as an adhesive, can be used to secure the strap end piece. The respective strap loop ends are then either used together, as shown in FIGS. 1 and 3, or bound together with a loop covering 46, as shown in FIG. 5, to form a single loop end at each end of the safety device. One loop on one end can be larger than the loop on the other end in order to more easily accommodate larger crane hooks.

In one embodiment, each strap is made from weaved synthetic material, such as nylon. In other embodiments (not shown), other materials and other shapes may be used for the straps, as long as the fracture strength of each strap can be reasonably predicted.

In order to provide each weaved strap with the indicated fracture strengths, the second strap 26 is wider than the first strap 22, and the second strap 26 is thicker than the first strap 22, as shown in FIGS. 2, 3 and 5. In other embodiments (not shown), other means of varying the fracture strength of each strap can be used. For example, a higher strength material, such as carbon fiber or steel, might be combined with the weave of the nylon.

To further provide a solid appearance to the safety device 10, a cloth device cover 42, as shown in FIGS. 1, 4 and 5, is stitched over a central portion of the first strap 22 and the second strap 26. In other embodiments, as shown in FIGS. 2 and 4, the cover can be omitted. The cloth device cover 42 does provide an added benefit to the safety device 10 in that the cloth device cover 42 rips before the first strap 22 fractures, and this ripping can produce an audio indication of the overload situation. The cloth can be made of any material that will both cover the straps and can be stitched to the straps and will tear at an appropriate fracture strength. For example, a weaved synthetic fiber can be used.

The advantage then of the disclosed safety device 10 is that it can be employed to tie back one or more hoist ropes. As described above, a machine operator may inadvertently start to operate the machine, forgetting that the hoist rope is in a tied back situation. When this occurs, the cover tears open. Then if the overload situation persists, then the first strap fractures, i.e., ruptures, once the load on the safety device 10 meets the first strap fracture strength. For example, the cover fracture strength may be 4,000 or 10,000 pounds of pull. Different fracture strengths are appropriate for different hoist machines, for a substantial load is applied to the safety device by virtue of the weight of hoisting rope and its rigging, such as rigging chains or crane hooks.

After the cover tears and the first strap fracture strength is exceeded, the first strap 22 will fracture. And in view of the load on the safety device 10, the second strap 26 will become extended; the folds 30 of the second strap 26 becoming unfolded. Since the fracture strength of the second strap 26 is greater than the current load on the safety device 10, the second strap 26 should remain in tack, and not fracture. This near immediate extension of the safety device 10 results in a momentary slack situation in the hoist rope 14. This momentary slack situation results in a jerk in the hoist rope, one that often produces noise and exceptional vibration in the hoisting machine, alerting bystanders to the potential danger. If the operator senses one or both of the noise and vibration, the machine operator can stop any further movement of the hoist machine.

If the operator does not sense the immediate extension of the safety device however, then eventually the fracture strength of the second strap may be exceeded, with the result that the hoist rope is no longer tied back.

Various other features of this disclosure are set forth in the following claims.

The invention claimed is:

1. A safety device adapted to be placed between a hoisting rope and a tie back attachment point when the hoisting rope is not in use, the safety device comprising two straps, the first strap being of a shorter length and a smaller fracture strength, and the second strap being of a longer length and a larger fracture strength, with the first strap and the second strap being attached together so that one end of the first strap and one end of the second strap are adapted to be attached together to the hoisting rope, and the other end of the first strap and the other end of the second strap are adapted to be attached together to the tie back attachment point, wherein the safety device further includes a device cover stitched over a portion of the first strap and the second strap.

2. A safety device according to claim 1 wherein the second strap has an inner portion folded back upon itself so that the folded length of the second strap is the same as the first strap.

3. A safety device according to claim 2 wherein the portion folded upon itself is stitched together.

4. A safety device according to claim 1 wherein the first strap and second strap are stitched together.

5. A safety device according to claim 1 wherein one end of the safety device is adapted to be attached to the hoisting rope by rope rigging.

6. A safety device according to claim 1 wherein the device cover is made of cloth.

7. A safety device according to claim 1 wherein a loop is formed at the end of each and every strap by having a strap end piece folded back upon a near portion of the strap.

8. A safety device according to claim 7 wherein where the strap end piece is folded back upon the near portion of the strap, it is secured in place by stitching so that the loop connection fracture strength exceeds the fracture strength of the remainder of the safety device.

9. A safety device according to claim 7 wherein the respective strap loop ends are bound together with a loop covering to form a single loop end at each end of the safety device.

10. A safety device according to claim 1 wherein each strap is made from weaved synthetic material.

11. A safety device according to claim 10 wherein each strap is made from weaved nylon.

12. A safety device adapted to be placed between a hoisting rope and a tie back attachment point when the hoisting rope is not in use, the safety device comprising two straps, the first strap being of a shorter length and a smaller fracture strength, and the second strap being of a longer length and a larger fracture strength, with the first strap and the second strap being attached together so that one end of the first strap and one end of the second strap are adapted to be attached together to the hoisting rope, and the other end of the first strap and the other end of the second strap are adapted to be attached together to the tie back attachment point, wherein the second strap is wider than the first strap.

13. A safety device according to claim 12 wherein the second strap is thicker than the first strap.

14. A safety device according to claim 12 wherein the second strap has an inner portion folded back upon itself so that the folded length of the second strap is the same as the first strap.

15. A safety device according to claim 12 wherein one end of the safety device is adapted to be attached to the hoisting rope by rope rigging.

16. A safety device adapted to be placed between a hoisting rope and a tie back attachment point when the hoisting rope is not in use, the safety device comprising two straps made from weaved synthetic material, the first strap being of a shorter length and a smaller fracture strength, and the second strap being of a longer length and a larger fracture strength, and the second strap being of a longer length and a larger fracture strength, with the first strap and the second strap being attached together so that one end of the first strap and one end of the second strap are adapted to be attached together to the hoisting rope, and the other end of the first strap and the other end of the second strap are adapted to be attached together to the tie back attachment point, the second strap having an inner portion folded back upon itself so that the folded length of the second strap is the same as the first strap, and a loop is formed at the end of each and every strap, the second strap being wider than the first strap, and the second strap being thicker than the first strap.

17. A safety device according to claim 16 wherein one end of the safety device is adapted to be attached to the hoisting rope by rope rigging.

18. A safety device adapted to be placed between a hoisting rope and a tie back attachment point when the hoisting rope is not in use, the safety device comprising two straps, the first strap being of a shorter length and a smaller fracture strength, and the second strap being of a longer length and a larger fracture strength, with the first strap and the second strap being attached together so that one end of the first strap and one end of the second strap are adapted to be attached together to the hoisting rope, and the other end of the first strap and the other end of the second strap are adapted to be attached together to the tie back attachment point, wherein the second strap is thicker than the first strap.

19. A safety device according to claim 18 wherein the second strap has an inner portion folded back upon itself so that the folded length of the second strap is the same as the first strap.

20. A safety device according to claim 18 wherein one end of the safety device is adapted to be attached to the hoisting rope by rope rigging.

* * * * *